United States Patent [19]

Högenett et al.

[11] 4,085,884

[45] Apr. 25, 1978

[54] PAPER SUPPLY BOX

[76] Inventors: Helmut Johann Högenett, Kreuzstr. 5, Inden, Germany, D 5176; Valentin Raimund Veithen, Buirer Str. 35, Golzheim, Germany, D 5159

[21] Appl. No.: 742,247

[22] Filed: Nov. 16, 1976

[30] Foreign Application Priority Data

Nov. 17, 1975 Germany ..... 7536471[U]

[51] Int. Cl.[2] ..... B65D 5/72

[52] U.S. Cl. ..... 229/17 S; 206/565; 312/61; 271/145; 221/279

[58] Field of Search ..... 229/17 R, 17 S; 206/555, 556, 557, 565; 312/61; 271/145, 167, 104, 121, 137; 221/279, 226

[56] References Cited

U.S. PATENT DOCUMENTS

| | | | |
|---|---|---|---|
| 546,849 | 9/1895 | Hughes | 312/61 X |
| 1,027,701 | 5/1912 | Deming | 206/565 X |
| 1,101,315 | 6/1914 | Metzgar | 206/565 X |
| 1,356,588 | 10/1920 | Bacher | 206/565 X |
| 2,019,802 | 11/1935 | Sproull | 206/565 X |
| 2,919,020 | 12/1959 | McCleary | 229/17 S X |
| 3,522,878 | 8/1970 | Rosenburg, Jr. | 229/17 S X |
| 3,767,188 | 10/1973 | Rosenburg, Jr. | 271/145 |

*Primary Examiner*—Davis T. Moorhead

[57] ABSTRACT

A box, preferably manufactured from folded cardboard, provides a paper supply container for copying or recording equipment or the like. The interior of the box contains one or more flaps which, as paper is removed from the box through a provided opening, move further into the box to prevent the addition of other paper thereto. This insures that only paper adapted for the particular equipment is employed.

4 Claims, 3 Drawing Figures

PAPER SUPPLY BOX

BACKGROUND OF THE INVENTION

The innovation pertains to a folding box manufactured of packing material, preferably cardboard, which can be used as a paper supply cassette (container) for copying or recording equipment.

It is a recognized procedure to package a specific quantity of copying or recording paper, cut to uniform size, into folding boxes which, after the removal of the superfluous portions of the box, can be inserted into the equipment as a unit containing the paper supply. Such insert boxes provide not only a convenience but also the guarantee that only paper specified for the particular equipment is used.

However, with the type of paper supply containers customary up until now, it is not possible to prevent the re-use or the insertion of a different sheet of paper, after the initial packing. Malfunctions of the equipment as well as mix-ups with the content of the container, due to outdated labelling of the paper supply container, were therefore not uncommon.

SUMMARY OF THE INVENTION

In accordance with the present invention, there is provided an improved box of the type used as a paper supply container for copying and recording equipment and the like. The improvement comprises at least one end of the box being adapted to provide an open end for removal therethrough of paper sheets from the box. In addition, at least one movable flap in the interior of the box, which at least one flap has an end fastened in the interior of the box and an opposite free end. The at least one flap lies in an initial position against one wall of the box and is adapted to move from its initial position towards an opposite wall of the box, as paper is removed therefrom, to a position in which the at least one flap blocks full insertion of other paper sheets into the interior of the box.

Certain objects of the invention are attained when the flaps are fastened in the interior of the box at ends thereof other than the open end.

In certain aspects of the invention, the box is a folded box comprised of a die cut packing material such as cardboard, and the one or more flaps are formed at folded over die cut edges in the interior of the box.

The innovation promotes the usage of the afore mentioned folding box inasmuch as, due to the new construction, the re-use or refilling of the container is prevented.

Characteristic of this newly developed folding box is the presence of at least one movable flap on one or more of the die-cut edges inside the folding box. During the emptying process of the container the flap moves further inside the container, thereby preventing the insertion of other paper.

During a proper first filling of the container the flaps will not interfere for the sheets are inserted into a partially folded box and the flap is held back by the inserted quantity of paper. Under the force of gravity and/or elasticity of the packing material the flap in the interior of the container will spread to the point where, in correlation with the feed mechanism of the copying or recording equipment, the paper can be extracted.

BRIEF DESCRIPTION OF THE DRAWINGS

The innovation is illustrated by the drawing of a preferred embodiment of the invention.

FIG. 1 shows in cross sectional view a box or container 5 which includes opposite walls 6 and 6′ containing a supply of sheets of paper P. Box 5 is provided with any suitable means for opening it at one end thereof for removal of sheets of paper P. For example, box 5 may be perforated about its periphery lying in the plane indicated by dotted line $x$—$x$ in FIG. 1 for removal of one end of box 5. FIG. 2 shows box 5 with one end 4 thereof opened, by removal of a portion of one end of box 5, to expose ends of sheets of paper P for removal through open end 4. As shown in FIGS. 2 and 3, box 5 contains a pair of flaps 3 which are connected at one end to box 5, more specifically, to the interior thereof, and which have an opposite free end. Flaps 3 are adapted to move from one wall 6 of box 5, through the interior of the box towards the opposite wall 6′ as paper is emptied therefrom (FIG. 2). This movement, as is apparent by comparing FIGS. 1 and 2, takes place by flaps 3 pivoting at or near their attached ends with their free ends moving from one wall towards the other. As is apparent from FIG. 2, the resultant position of flaps 3 will serve to prevent the insertion of other sheets of paper into box 5 by blocking insertion of paper through open end 4 fully into the interior of box 5.

Figure 1:
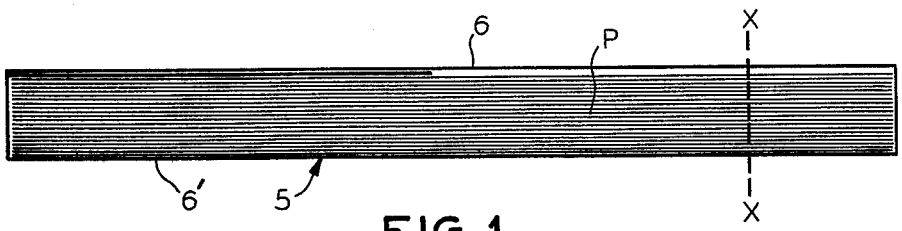
FIG. 1 shows a cross-sectional view of the filled container.
Figure 2:
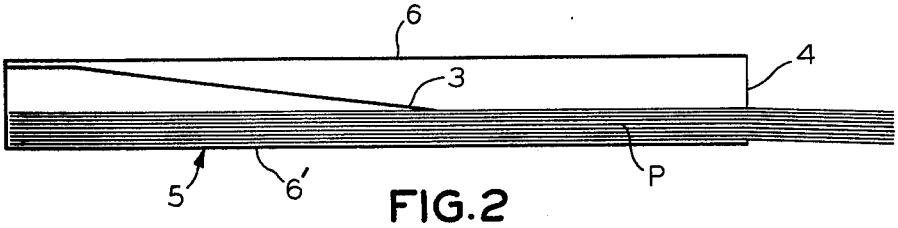
FIG. 2 shows a cross-sectional view of a half empty container showing the embodiment of the invention.
Figure 3:
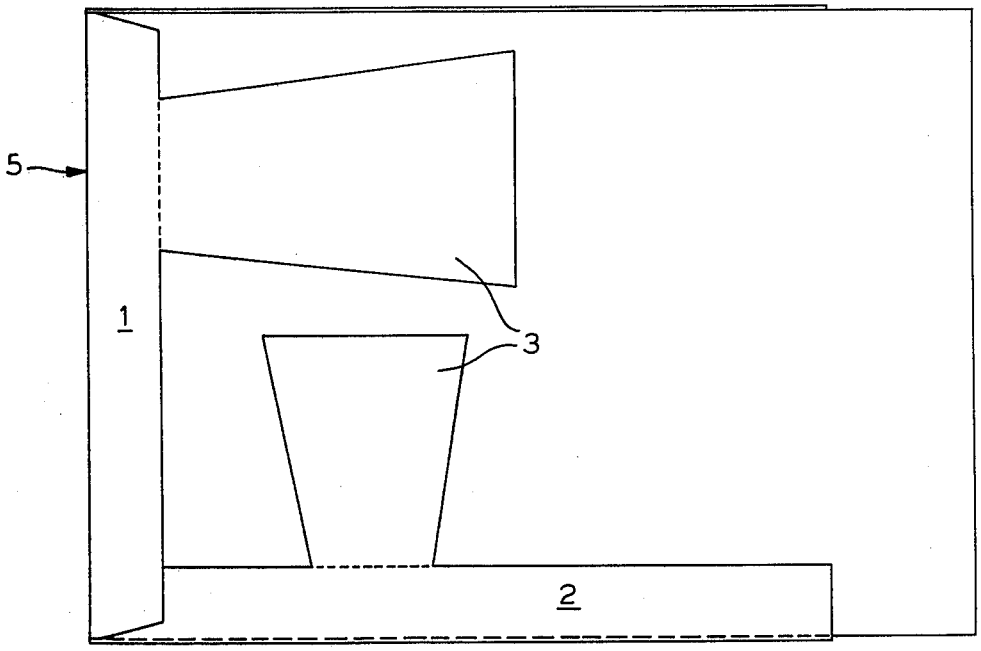
FIG. 3 is a top view of the container of FIGS. 1 and 2, however with the cover removed.

Note that the flaps 3 are formed at the respective edges of folded over portions 1, 2 of the die cut material. Folded over portion 2 extends along one (long) side of the box and folded over portion 1 lies along an adjacent (short) end of the box. Flaps 3 thus initially (when box 5 is filled with sheets of paper P) are held against a wall 6 of box 5 and move inwardly of box 5 towards an opposite wall 6′ thereof as sheets of paper P are removed through open end 4.

As seen in the drawings, flaps 3 are fastened at respective one ends thereof at ends of box 5 other than open end 4. One of flaps 3 is fastened in the interior of box 5 at an end thereof opposite open end 4.

We claim:

1. An improved box of the type used as a paper supply container for copying and recording equipment and the like, the improvement comprising at least one end of said box being adapted to provide an open end for removal therethrough of paper sheets from the interior of said box, said box being made of a folded die cut material and having therewithin a folded over portion disposed adjacent ends thereof other than said one end of said box, at least two movable flaps in the interior of said box, said flaps each having one end fastened in the interior of said box and an opposite free end, said flaps each lying in an initial position within said box against one wall of said box and being adapted to move from said initial position towards an opposite wall of said box, as paper is removed therefrom, to a position in which said flaps block full insertion of other paper sheets into the interior of said box.

2. The box of claim 1 wherein said die cut material is cardboard.

3. The box of claim 1 wherein at least one of said flaps is fastened at an end of said box opposite said open end.

4. The box of claim 1 including two of said flaps, one of which is fastened at said end of said box opposite said other end and the other of which is fastened at an end adjacent said other end.

* * * * *